US007789193B2

(12) United States Patent
Suzuki

(10) Patent No.: US 7,789,193 B2
(45) Date of Patent: Sep. 7, 2010

(54) SOUND INSULATING DEVICE

(76) Inventor: Masao Suzuki, 5-13, Kajino-cho 2-chome, Koganei-shi, Tokyo 184-0002 (JP)

( * ) Notice: Subject to any disclaimer, the term of this patent is extended or adjusted under 35 U.S.C. 154(b) by 0 days.

(21) Appl. No.: 12/225,825

(22) PCT Filed: Apr. 27, 2006

(86) PCT No.: PCT/JP2006/308865

§ 371 (c)(1),
(2), (4) Date: Sep. 30, 2008

(87) PCT Pub. No.: WO2007/125577

PCT Pub. Date: Nov. 8, 2007

(65) Prior Publication Data

US 2009/0266645 A1 Oct. 29, 2009

(51) Int. Cl.

| | |
|---|---|
| ***E04H 17/14*** | (2006.01) |
| ***G10K 11/16*** | (2006.01) |
| ***E04B 1/84*** | (2006.01) |
| ***E04B 1/82*** | (2006.01) |
| *E04H 17/00* | (2006.01) |
| *G10K 11/00* | (2006.01) |
| *E04B 1/86* | (2006.01) |

(52) U.S. Cl. ..... 181/210; 181/285; 52/145

(58) Field of Classification Search ..... 181/210, 181/285, 287, 284, 290, 293; 52/144, 145
See application file for complete search history.

(56) References Cited

U.S. PATENT DOCUMENTS

| | | | | | |
|---|---|---|---|---|---|
| 1,791,232 | A * | 2/1931 | Borkenstein | 181/293 |
| 2,306,685 | A * | 12/1942 | Chambers | 362/150 |
| 2,771,164 | A * | 11/1956 | Scurlock | 52/404.1 |
| 3,026,224 | A * | 3/1962 | Rogers, Jr. | 428/167 |
| 4,094,379 | A * | 6/1978 | Steinberger | 181/284 |
| 4,477,505 | A * | 10/1984 | Warnaka | 428/160 |
| 5,024,290 | A * | 6/1991 | Birker | 181/293 |
| 5,272,284 | A * | 12/1993 | Schmanski | 181/210 |
| 5,362,931 | A * | 11/1994 | Fries | 181/284 |
| 5,587,564 | A * | 12/1996 | Stief et al. | 181/295 |
| 5,854,453 | A * | 12/1998 | Fujiwara et al. | 181/293 |
| 5,912,440 | A * | 6/1999 | Murakami et al. | 181/210 |
| 5,984,044 | A * | 11/1999 | Christensen | 181/210 |
| 6,153,286 | A * | 11/2000 | Pfaffelhuber et al. | 428/178 |
| 6,200,664 | B1 * | 3/2001 | Figge et al. | 428/178 |
| 6,209,680 | B1 * | 4/2001 | Perdue | 181/295 |
| 6,457,554 | B1 * | 10/2002 | Wang | 181/282 |
| 6,491,134 | B2 * | 12/2002 | Ryan et al. | 181/295 |
| 7,308,965 | B2 * | 12/2007 | Sapoval et al. | 181/210 |

(Continued)

FOREIGN PATENT DOCUMENTS

| | | | |
|---|---|---|---|
| CH | 671054 | A * | 7/1989 |

(Continued)

*Primary Examiner*—Edgardo San Martin
(74) *Attorney, Agent, or Firm*—Wenderoth, Lind & Ponack, L.L.P.

(57) ABSTRACT

In a sound insulating device, a long sound insulating member including a polyhedron body bent at a predetermined angle to open a sound source side is sequentially stacked between supporting columns arranged in an upstanding manner at a predetermined spacing to configure a sound insulating wall 10 having an appropriate height. Sound waves from a sound source interfere with each other due to the polyhedron body to reduce noise.

8 Claims, 9 Drawing Sheets

U.S. PATENT DOCUMENTS

| | | | | |
|---|---|---|---|---|
| 7,571,790 | B2 * | 8/2009 | Kim | 181/293 |
| 2003/0019170 | A1 * | 1/2003 | Donnelly | 52/144 |
| 2006/0131104 | A1 * | 6/2006 | Yamaguchi et al. | 181/293 |
| 2006/0169531 | A1 * | 8/2006 | Volker | 181/204 |
| 2007/0131480 | A1 * | 6/2007 | Corbin et al. | 181/210 |
| 2008/0066393 | A1 * | 3/2008 | Sorensen | 52/81.1 |
| 2009/0038883 | A1 * | 2/2009 | Kim | 181/291 |
| 2009/0117311 | A1 * | 5/2009 | Kuzmin | 428/44 |

FOREIGN PATENT DOCUMENTS

| | | | |
|---|---|---|---|
| DE | 3313813 | A1 * | 10/1984 |
| DE | 3728103 | A1 * | 3/1989 |
| DE | 3937756 | A1 * | 6/1990 |
| EP | 214524 | A1 * | 3/1987 |
| EP | 361025 | A1 * | 4/1990 |
| JP | 10-25714 | | 1/1998 |
| JP | 11-327562 | | 11/1999 |
| JP | 2002-88950 | | 3/2002 |
| JP | 2004-132018 | | 4/2004 |
| JP | 3660335 | | 3/2005 |
| WO | WO 9411222 | A1 * | 5/1994 |

* cited by examiner

SOUND INSULATING DEVICE

BACKGROUND OF THE INVENTION

The present invention relates to a sound insulating device for reducing noise from vehicles, trains and the like in expressways or railroads, or other sound sources.

Conventionally, a sound insulating device in which a plurality of plate shaped sound insulating members is attached to an H-shaped steel beam arranged in an upstanding manner in plural numbers along a road, a railway track, and the like, and this sound shielding member is arranged in a form of a wall surface is known.

This type of sound insulating device has an advantage in that the configuration is simplified, the number of components is few, and the workability is satisfactory since the sound insulating member is stacked in plural numbers in an up and down direction by fitting both ends from above the H-shaped steel beam when being attached to the H-shape steel beam so that the sound insulating member is directly attached to the H-shaped steel beam.

Such sound insulating device includes a railroad soundproof wall arranged on a ground along the track of the railroad vehicle, forming a sound absorbing surface on the surface facing the track of the upstanding wall part, and absorbing rolling noise of the wheels and noise from the motor (see for example, patent document 1).

The sound absorbing panel at this soundproof wall is made by filling sound absorbing materials such as glass wool inside a flat box having a sound absorbing surface side of the front surface as porous plate and the rear surface as steel plate, and this sound absorbing panel is attached by being stacked vertically with respect to a supporting column arranged on the track.

In addition, a sound insulating wall arranged on the road or the railroad is known, where the sound insulating wall is attached to the upstanding H-shaped steel beam by stacking a plurality of panel shaped sound absorbing plates, in which sound absorbing materials are filled in a box frame, in the up and down direction (see for example, patent document 2).

The sound insulating wall aims to enhance air tightness by interposing an elastic air tight member on the contacting surface of the sound absorbing plate in addition to the sound absorbing plate stacked in the up and down direction, and to prevent sound leakage.

This sound insulating member in such sound insulating wall incorporates sound absorbing materials such as glass wool and cotton in the box shaped case having a great number of sound absorbing holes perforated in the front surface, or sandwiches the same with a louver, and aims to insulate sound by absorbing noise at the sound absorbing material.

[Patent document 1] Japanese Publication No. 3660335

[Patent document 2] Japanese Laid-Open Patent Publication No. 2004-132018

The soundproof wall described in patent document 1 and patent document 2 attempts to absorb noise by means of sound absorbing material, but since both front surface and rear surface of the aluminum plate materials sandwiching the sound absorbing material contact with the sound absorbing material because of its structure when the sound absorbing material is used, the sound wave easily reflects and lowers the sound absorbing efficiency.

Furthermore, when sound absorbing materials such as glass wool and cotton are used, moisture such as rainwater and snow is absorbed since such sound absorbing material has water retention characteristics, and thus the sound absorbing performance temporary lowers. Furthermore, the sound absorbing material degrades by absorption of such moisture, whereby the sound absorbing performance becomes difficult to maintain over a long period and maintenance such as repair and replacement must be carried out frequently to maintain the sound absorbing performance.

In addition, such soundproof wall requires a gap to be filled with a different sound absorbing member sandwiched between a flange of the H-shaped steel and the sound insulating member, or the sound insulating member to be fixed to the H-shaped steel by a bolt and the like to fix the sound insulating member to the H-shaped steel beam when attaching the sound insulating member to the H-shaped steel beam, and thus assembly workability gradually degrades. Furthermore, since the sound absorbing material is used, problems such as the weight increasing, and the number of components increasing occurs.

Problems such as the sound shielding member having a complicated configuration, the manufacturing becoming difficult, and cost increases occur since it is configured by a plurality of members as described above. When the sound insulating member breaks, the sound absorbing material must be disposed as industrial waste, and thus a problem in that the processing cost increases occurs.

The present invention is developed to overcome the problems of the prior art, and aims to provide a sound insulating device that exhibits excellent sound insulating property, which sound insulating device is capable of maintaining this sound insulating property over a long period, excels in assembly workability, and is easily manufactured and readily disposed of.

SUMMARY OF THE INVENTION

To attain the above object, the invention is directed to a sound insulating device, wherein a long sound insulating member including a polyhedron body bent at a predetermined angle to open a sound source side is sequentially stacked between supporting columns arranged in an upstanding manner at a predetermined spacing to configure a sound insulating wall having an appropriate height. A sound wave from the sound source is interfered due to the polyhedron body to reduce noise.

The invention is also directed to a sound insulating device, wherein the supporting column uses a H-shaped steel beam, and the sound insulating members are stacked and fixedly attached by sandwiching a sandwiching portion formed at both ends of the sound insulating member between flanges of the H-shaped steel beam.

The invention is also directed to a sound insulating device, wherein the sandwiching portion is formed by arranging a cutout portion at both ends of the sound insulating member, a width allowing the sandwiching portion to be inserted between the flanges of the H-shaped steel is provided by the cutout portion, and the sandwiching portion is inserted and held between the flanges.

The invention is also directed to a sound insulating device, wherein each bent portion of the sound insulating member is bent to 142° to configure the polyhedron body.

The invention is also directed to a sound insulating device, wherein one end side of the sound insulating member is bent to an opening side on a side opposite to a bending direction of the bent portion to form a bending portion. An elastic member such as an elastomer is fitted between the sound insulating member that overlaps the bending portion.

The invention is also directed to a sound insulating device, wherein a blocking plate is fixedly attached to both ends of the sound insulating member by means such as spot welding.

The invention is also directed to a sound insulating device, wherein a through hole is formed near upper and lower ends of the sound insulating member. A connecting rope-like material is inserted through the through hole to integrally hold the stacked sound insulating members.

The invention is also directed to a sound insulating device, wherein the insertion of the connecting rope-like material is easily ensured by interposing a pipe member between the upper and lower pass-trough holes.

According to the invention, a sound insulating device that exerts an excellent sound insulating property is provided, the sound insulating device being capable of maintaining this sound insulating property over a long period by excellent durability. Furthermore, the sound insulating device also excels in assembly workability, can be easily manufactured and readily disposed of, and thus can suppress costs.

According to the invention, the sound insulating device is such that a wall surface is formed by simply attaching the sound insulating members with respect to the supporting column. Furthermore, the width of the sandwiching portion can be changed on site, whereby the dimension between the sandwiching portion can be adjusted with respect to the dimension between the different flanges of the H-shaped steel, thereby reliably attaching the sound insulating member.

According to the invention, the sound insulating device can reduce the noise most effectively, and can exert high sound insulating property. Furthermore, the sound insulating device can be easily formed, and cost such as material cost and processing cost can be reduced.

According to the invention, the sound insulating device that can further enhance the noise reducing effect by effectively preventing sound leakage, and that excels in decoration, and can enhance safety is obtained.

According to the invention, the sound insulating device that further enhances sound insulating property and can reliably prevent sound leakage to the outside. Furthermore, the sound insulating member can easily be attached between the flanges of the H-shaped steel beam since the shape thereof can be held, and can enhance the durability by enhancing the strength of the sound insulating member.

According to the invention, the sound insulating device can strongly hold the sound insulating members in a stacked state, and absorb impact with the entire sound insulating member that is fixed when impacted by car, train or the like to alleviate the shock.

According to the invention, the sound insulating device can easily allow insertion of the connecting rope-like material through the stacked sound insulating members, and can enhance workability and safety.

BRIEF DESCRIPTION OF THE DRAWINGS

The invention, together with objects and advantages thereof, may best be understood by reference to the following description of the presently preferred embodiment together with the accompanying drawings in which.

DETAILED DESCRIPTION OF THE PREFERRED EMBODIMENTS

One embodiment of a sound insulating device according to the present invention will now be described in detail based on the drawings.

Figure 2:
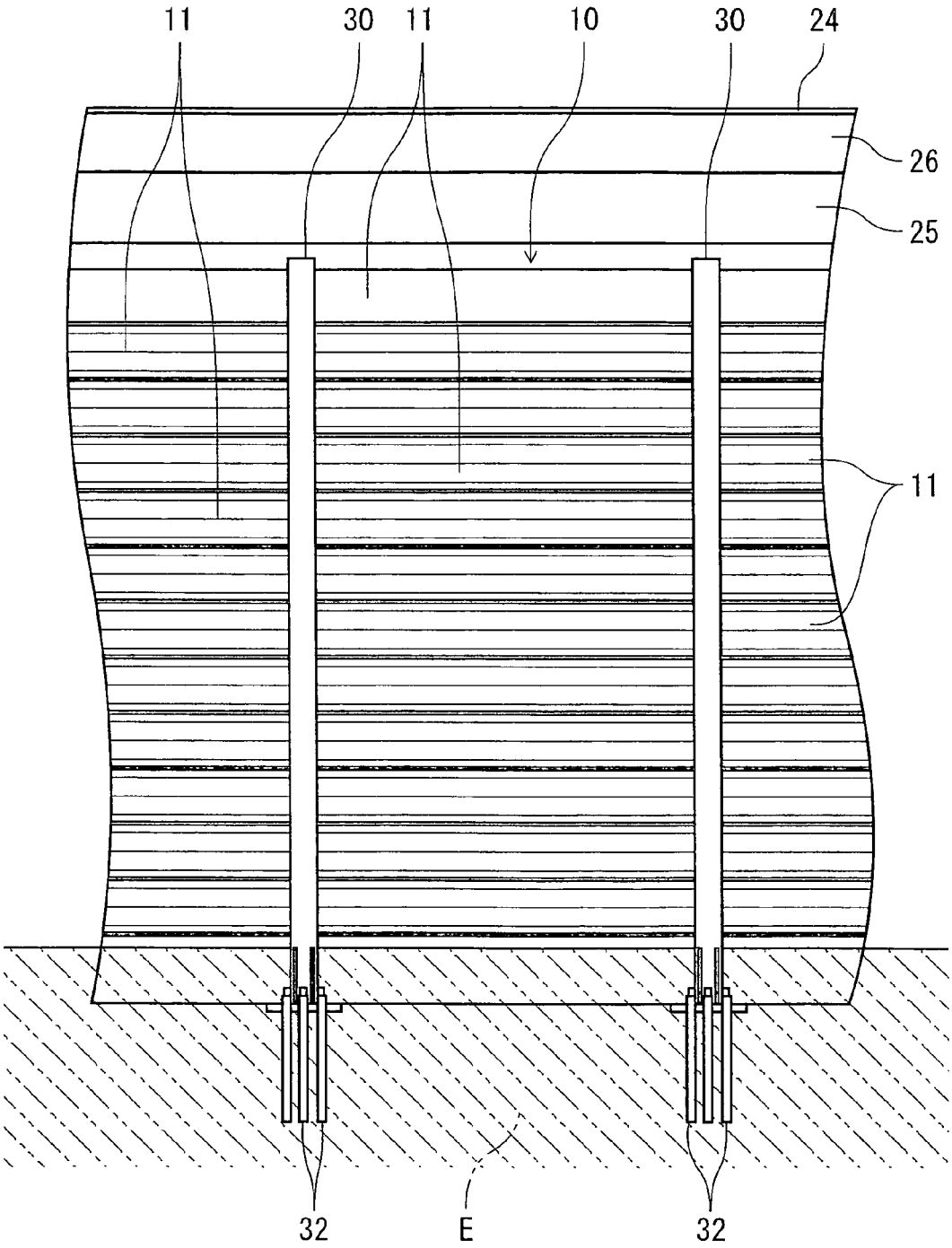
FIG. 2 is a front view showing the sound insulating device according to the present invention.
Figure 3:
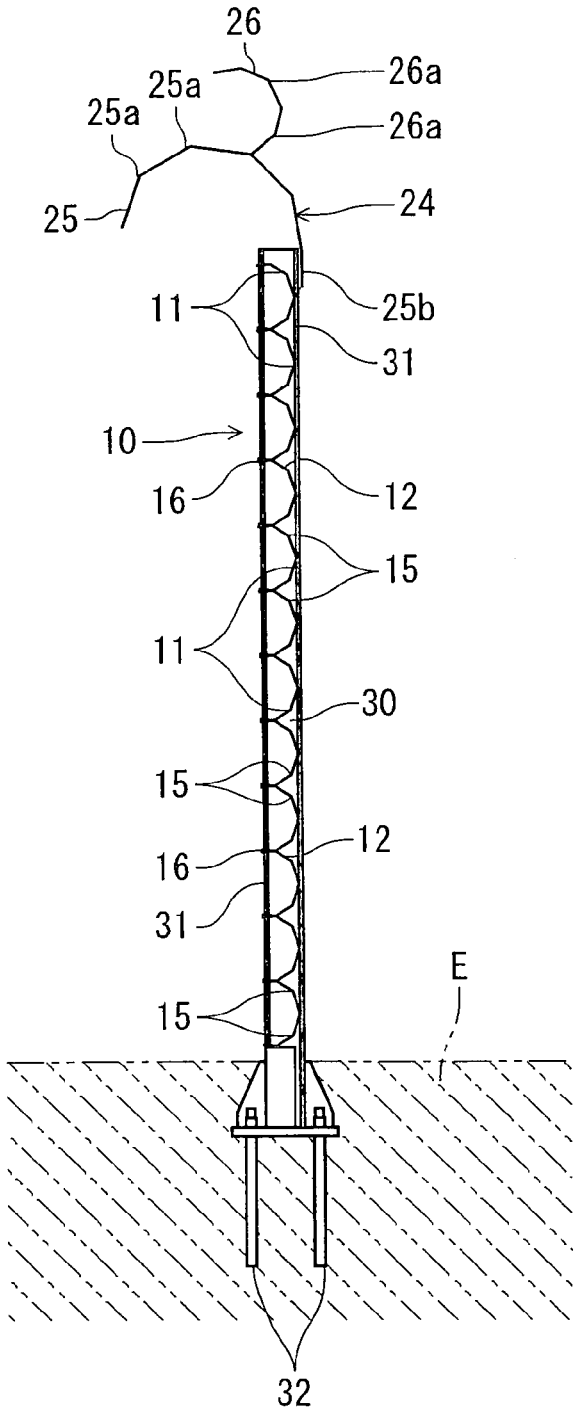
FIG. 3 is a cross sectional view taken along line A-A of FIG. 2.
Figure 4:
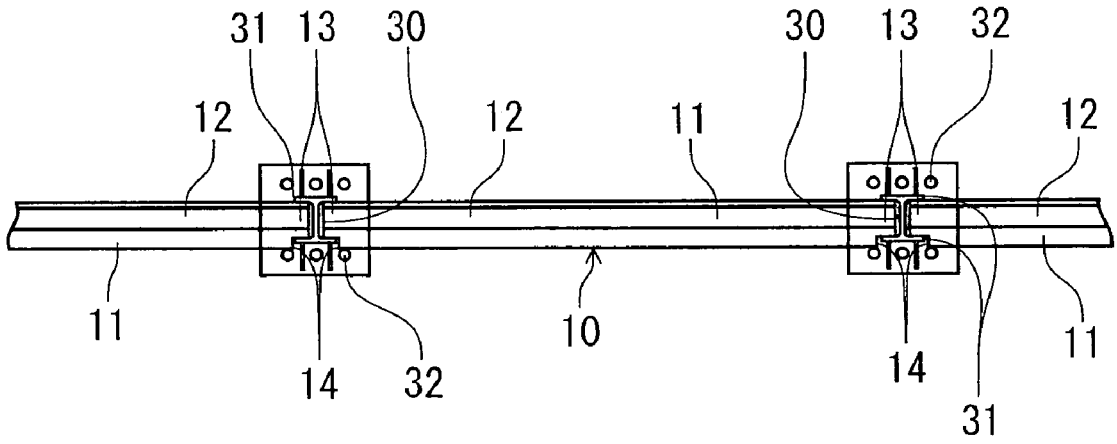
FIG. 4 is an enlarged plan view of FIG. 2.

A supporting column (or beam) 30 is arranged in an upstanding manner at a predetermined spacing on both sides or on one side of a expressway (including a general road), and railroad track as shown in FIG. 2, where a lower part of this supporting column 30 is embedded in the ground E by a predetermined length. Furthermore, the lower part of this supporting column 30 is fixed by an anchor bolt 32, as shown in FIGS. 3 and 4. In the present embodiment, the supporting column 30 uses an H-shaped steel beam which is a general product, and is arranged in an upstanding manner at spacing of 2000 mm.

Figure 1:
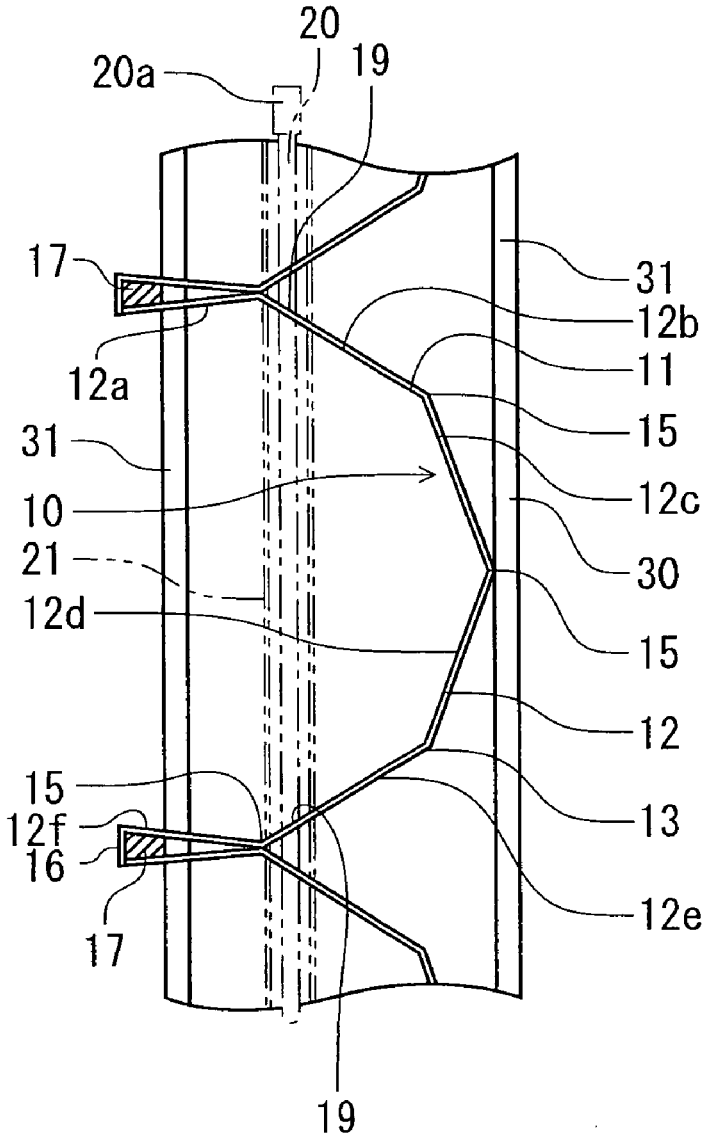
FIG. 1 is a partially enlarged longitudinal cross sectional view showing a sound insulating device according to the present invention.

In FIGS. 1 to 3, a sound insulating member 11 is bent at a predetermined angle and has the sound source side opened.

The sound insulating member 11 is formed by forming a long thin plate with aluminum for the material, and press working the same to mold the plate into a long polyhedron shape. The bent angle of each bent portion 15 is 142°, whereby the polyhedron body 12 having plane portions 12*a*, 12*b*, 12*c*, 12*d*, 12*e*, and 12*f* shown in FIG. 1 is formed. In the molding processing of the sound insulating member 11, the member is formed to have a thickness of about 1.8 mm and a length of about 2000 mm, which is the spacing of the H-shaped steel beam 30. In addition, the height is about 250 mm.

Figure 5:
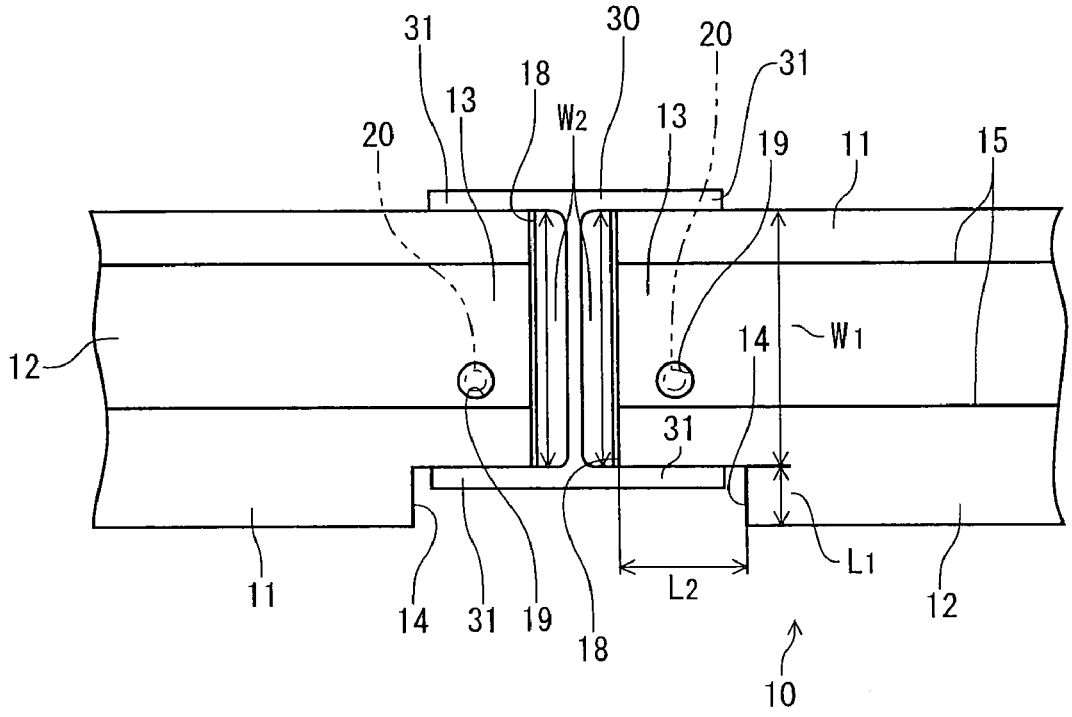
FIG. 5 is an enlarged view of the main parts of FIG. 4.
Figure 6:
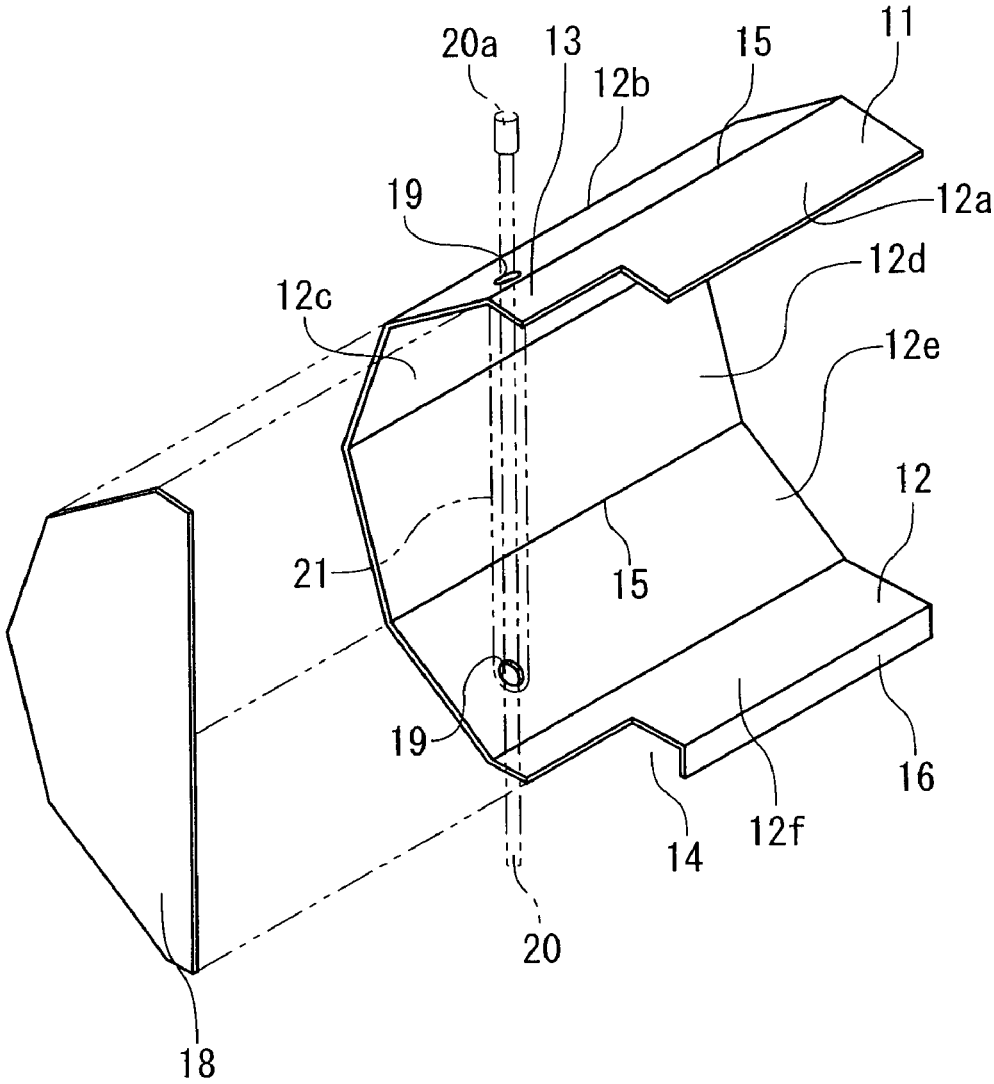
FIG. 6 is a partially enlarged perspective view of a sound insulating wall.

As shown in FIGS. 5 and 6, a sandwiching portion 13 is formed at both ends of the sound insulating member 11. This sandwiching portion 13 is formed by arranging a cutout portion 14 at both ends of the sound insulating member 11, in which cutout portion 14 is cutout by length $L_1$ so that the width $W_1$ of the sandwiching portion 13 is slightly smaller than the width $W_2$ between the flanges 31, 31 of the H-shaped steel 30, and to a width enabling the sandwiching portion 13 to be inserted between the flanges 31, 31 of the H-shaped steel 30 by this cutout portion 14.

On the other hand, the length $L_2$ in the long direction of the cutout portion 14 is set to a length that the sandwiching portion 13 can be attached to the flange 31, but a slight margin is desirably provided. Thus, even if dimension error is produced in the spacing of the upstanding H-shaped steel beams 30, 30, the error can be absorbed thereby reliably attaching the sound insulating member 11. The sound insulating member 11 is positioned in the length direction after attachment by the cutout portion 14, and is prevented from oscillating with respect to the H-shaped steel 30.

The sound insulating member 11 configures a sound insulating wall 10 having an appropriate height by inserting and sandwiching the sandwiching portions 13, 13 at both ends between the flanges 31, 31, and sequentially stacking and fixedly attaching this sound insulating member 11 between the H-shaped beams 30, 30. In the present embodiment, a plurality of sound insulating members 11 is appropriately stacked to have the height of the sound insulating wall 10 of about 3000 mm. The sound insulating member 11 is positioned in the front and back direction with respect to the H-shaped steel beam 30 by being held between the flanges 31, 31.

When the sound insulating members 11 are stacked, the bent portions 15, 15 of the upper and lower sound insulating members 11 contact each other, and thus are positioned in the height direction as shown in FIG. 1.

A buffer material made of elastic body (not shown) may be interposed between the bent portions 15, 15, in which case, the upper and lower sound insulating members 11, 11 are reliably positioned and fixed while absorbing dimension error via the buffer material.

The sound insulating member 11 is also continuously arranged in the left and right directions by being attached between the continuously arranged H-shaped beams 30, 30 . . . .

The sound insulating member 11 causes the sound wave from the sound source to interfere with each other by the plane portions 12*a*, 12*b*, 12*c*, 12*d*, 12*e*, 12*f* of the polyhedron body 12 by being arranged such that the opening side of the polyhedron body 12 faces the sound source side, whereby noise can be reduced.

As shown in FIG. 6, a blocking plate 18 is fixedly attached by means of spot welding and the like at both ends of the sound insulating member 11, and the ends of the sandwiching portion 13 are covered by this blocking plate 18. Thus, the ends of the sound insulating member 11 are blocked, and the sound is prevented from leaking from this end side. Both ends of the sound insulating member 11 are reinforced by fixedly attaching this blocking plate 18, thereby preventing the sound insulating member 11 from distorting.

A bending portion 16 is formed by being bent to the opening side opposite to the bending direction of the bent portion 15 at the lower end side which is one end of the sound insulating member 11. An end side of the other sound insulating member 11 contacts this bending portion 16 when the sound insulating members 11 are stacked in the up and down direction as in FIG. 1, thereby blocking an opening portion formed by the upper and lower sound insulating members 11, 11.

An elastic member 17 such as an elastomer is fitted between the sound insulating members 11 overlapping the bending portion 16. The elastic member 17 is formed to a cross sectional shape that can be fitted between the bent portion 15 and the bending portion 16, is formed long to adapt to the length of the sound insulating member 11, or is formed short to be fitted at an appropriate spacing.

The bending portion 16 may be omitted, in which case, a cap (not shown) is arranged in place of the bending portion 16, and the opening portion created by the upper and lower sound shielding members 11, 11 is covered by this cap.

In FIG. 6, through holes 19, 19 are formed at an appropriate position near the upper and lower ends of the sound insulating member 11, and are provided so as to allow a connecting rope-like material 20 to be inserted in the through holes 19, 19. The connecting rope-like material 20 is formed by forming an elongated carbon, and twisting this carbon material to a wire form.

In inserting the connecting rope-like material 20, each through hole 19 is continuously passed through up to the sound insulating member 11 on the lower side from the sound insulating member 11 on the upper side of the H-shaped steel 30, where this connecting rope-like material 20 can be formed with an enlarged diameter part 20*a*, for example, as shown in the figure in advance so as to be in a tensioned state while preventing slip-out from above or below, and the stacked sound insulating members 11 can be integrally held by the connecting rope-like material 20. When the connecting rope-like material 20 is provided, even when a force is applied on the opening side through, for example, impact of a vehicle or train, such force can be dispersed and alleviated at the sound insulating members 11 stacked in the up and down direction via the connecting rope-like material 20.

As shown in chain double-dashed line in FIGS. 1 and 6, a pipe member 21 may be fixedly attached between the upper and lower through holes 19, 19 while being interposed in the sound insulating member 11, thereby easily ensuring insertion of the connecting rope-like material 20. In this case, when the connecting rope-like material 20 is inserted from one through hole 19, the material 20 is easily taken out from the other through hole 19, and thus the connecting rope-like material 20 can be easily passed through the stacked sound insulating member 11.

Although not shown, the pipe member is arranged long to the height of the sound insulating wall 100, and the pipe member is attached with respect to the stacked sound insulating members 11, 11. In this case, the connecting rope-like material 20 can be passed through the through hole 19 of the upper most sound insulating member 11 to the through hole 19 of the lower most sound insulating member 11 at once, whereby the connecting rope-like material 20 can be easily inserted.

Furthermore, although not shown, after the connecting rope-like material 20 is passed through the through holes 19 of the sound insulating members 11 stacked in the vertical direction, the connecting rope-like material 20 is passed through the through hole 19 of the sound insulating member 11 adjacently stacked in the vertical direction to cross the H-shaped steel beam 30 so that the connecting rope-like material 20 is tensioned in a substantially U-shaped state thus preventing slip-out of the end of the connecting rope-like material 20, whereby two stacked sound insulating members 11 can be held with one connecting rope-like material 20, and the attachment task is simplified.

In the present example, a noise eliminator 24 of polyhedron type such as soundproof head board (registered trademark) patent filed by the applicant of the present invention is attached to the upper part of the sound insulating wall 10, as shown in FIGS. 2 and 3.

The sound eliminator 24 is made up of a first polyhedron member 25 and a second polyhedron member 26, which are formed into a polyhedron by bending an aluminum material to a predetermined angle (142°) by processing means such as press molding and forming bent portions 25*a*, 26*a*. The thickness, height, and depth thereof can be changed according to the required sound insulating property and the state of the road and railroad to which it is to be attached. The length is the same length as the sound insulating member.

The first polyhedron member 25 is attached with a lower part side of an attachment part 25*b* opened to the upper end of the back side of the sound insulating wall 10. The second polyhedron member 26 has the lower part side attached so as to open in a substantially horizontal direction near the vertex of the first polyhedron member 25.

When noise is produced, the sound wave is sound insulated by the sound insulating wall 10, but some of the sound wave advances upward along the sound insulating wall 10 and attempts to circumvent to the outer side of the sound insulating wall 10.

When the sound eliminator 24 is arranged, the sound wave attempting to circumvent is sound insulated by interfering and canceling the sound wave similar to sound insulation of the sound insulating member 11, to be hereinafter described, by the first polyhedron member 25.

The sound wave also advances upward and attempts to circumvent the first polyhedron member 25, but the sound wave that has advanced to the outer side of the first polyhedron member 25 advances to the inner side of the second polyhedron member 26 and thus is sound insulated, similar to the above, whereby leakage of sound waves is prevented.

Therefore, when the noise (sound waves) that cannot be sound insulated by the sound insulating wall 10 advances upward, the leakage to the outer side is suppressed to a minimum by the double sound insulating members arranged at a high position.

In the present example, the sound eliminator 24 of the above configuration is provided, but may be a sound eliminator of other configurations, where high sound insulating effect is exerted and high frequency region (high note) is also reliably sound insulated when such sound eliminator is provided compared to when only the sound insulating wall 10 is provided.

The sound insulating member 11 may be arranged in shapes other than the above as long as it is a polyhedron shape, and the length may be changed so as to correspond to the spacing of the H-shaped steel 30, the thickness may be changed to enhance strength, or the height may be changed. The processing means may be different molding means such as extrusion and pultrusion in addition to press molding.

The sound insulating member 11 forms the sandwiching portion 13 by forming the cutout portion 14, and thus the dimension of the sandwiching portion 13 can be changed by changing the cutout dimension of the cutout portion 14. The sandwiching portion 13 may be attached to the H-shaped steel 30 including flange 31 of different lengths by changing the dimension of the sandwiching portion 13.

The sandwiching portion may be formed by means other than arranging the cutout portion 14 as long as it has a shape of being sandwiched between the flanges 31, 31 of the H-shaped steel beam 30, and the forming means is not limited to the above described mean. In the present example, the H-shaped steel beam is used as the supporting column 30 due to the reason of being universal, but the supporting column 30 is not particularly limited to the H-shaped steel beam, and a universal product corresponding to the shape of the sandwiching portion may be used. In addition, the sound insulating member 11 may have a portion other than the sandwiching portion 13 projecting out to the sound source side, where the upper and lower portions of the sound insulating member 11 may be projected out to form a large sound insulating site in FIG. 1.

The sound insulating member 11 uses aluminum as the material, but metal materials other than aluminum or resin may be used. In particular, when forming the sound insulating member 11 by resin, the visibility can be improved by using transparent or semi-transparent resin, whereby the surrounding view is enhanced and light can be let in through the sound insulating member.

The height of the sound insulating wall 10 and a sound eliminator 22 may be appropriately changed depending on the magnitude of the noise produced from the vehicle or train serving as the sound source, and height (height of vehicle and train) of the noise producing origin. In an aim of enhancing the view from the vehicle and the train, reducing cost, and enhancing work efficiency in assembling, may be set to an arbitrary height according to the installing state.

A simulation of a noise measuring test was performed for the sound insulating device of the present embodiment, and the result thereof will be shown.

A simulation method is a two-dimensional boundary element method (hereinafter referred to as 2D-BEM), where insertion loss of the sound insulating wall in a semi-free space having reflective ground is obtained. This is because the insertion loss obtained by the 2D-BEM substantially matches the insertion loss value of when a point sound source and a sound receiving point are arranged in a cross section perpendicular to the target sound insulating wall.

Figure 7:
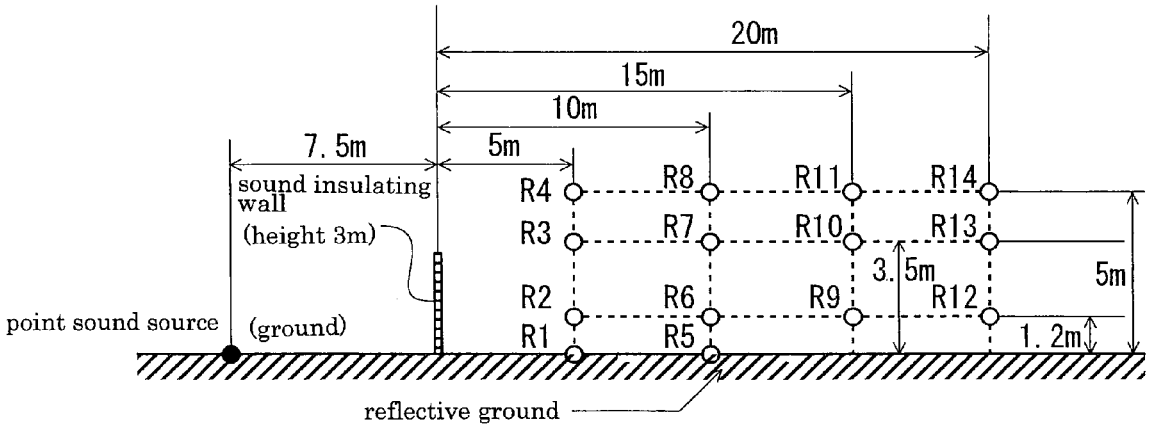
FIG. 7 is an explanatory view showing an arrangement in a noise measuring test.

The arrangement of the sound source, the sound insulating wall, and the sound receiving point in the noise measuring test is shown in FIG. 7. The sound source is arranged on the ground as a point sound source at a position away from the sound insulating wall by 7.5 m. The sound receiving point is arranged at fourteen locations of R1 to R14 at different distance and length from the sound insulating wall. The position of each sound receiving point (distance, height from sound insulating wall) is as shown in the figure.

The sample article used in the simulation was only the sound insulating wall formed to have a height of 3 m and a width of 150 mm, and a sound eliminator was not attached. Three types of sound insulating walls were tested as the sample.

Figure 8:
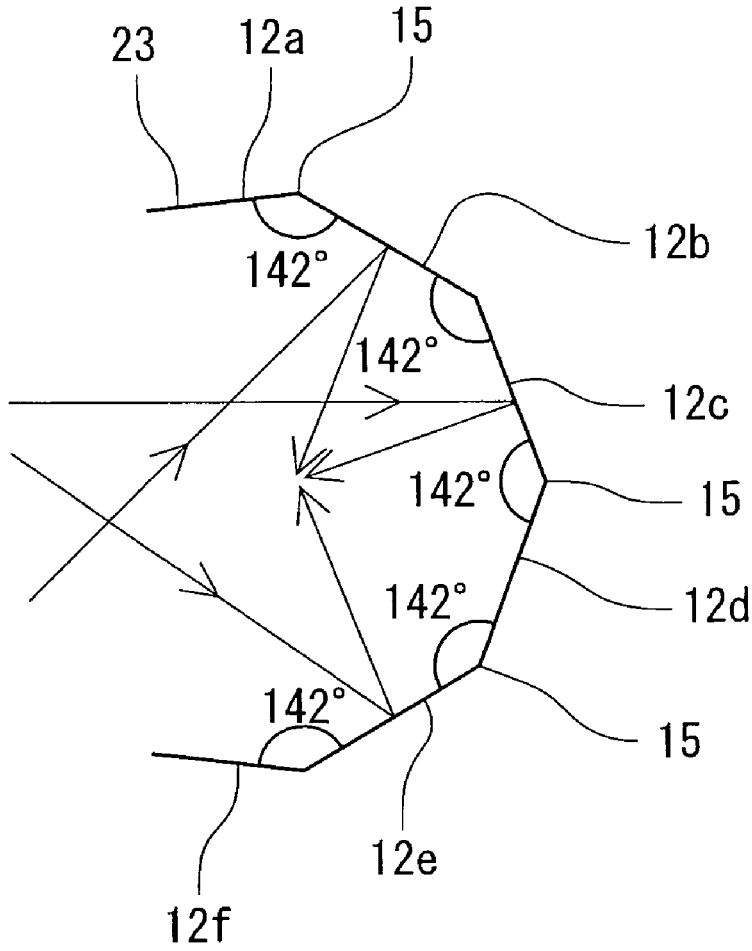
FIG. 8 is a side view showing a unit body of a sound insulating member in a noise measuring test.

Sample 1 was a reflective linear wall. Sample 2 was a sound absorbing linear wall, where the sound absorbing property was 0.8 and had a configuration similar to the sound insulating wall that is generally used. Sample 3 was a sound installing device of the present invention, where the sound insulating member 23 shown in FIG. 8 was stacked in the vertical direction to form the wall surface. The thickness of samples 1 to 3 was the same, and the conditions by the thickness were conformed.

The sound pressure level of each sound receiving point of R1 to R12 was obtained for when the sound insulating wall by each sample was arranged and for when the sound insulating wall was not arranged by the 2D-BEM under the above described conditions, and the insertion loss of the sound insulating wall by each sample was obtained by the following equation.

$$IL = L_0 - L_B$$

Where IL is the insertion loss (dB), $L_0$ is the sound pressure level (dB) of when the sound insulating wall was not arranged, and $L_B$ is the sound pressure level (dB) of when the sound insulating wall was arranged.

Figure 9:
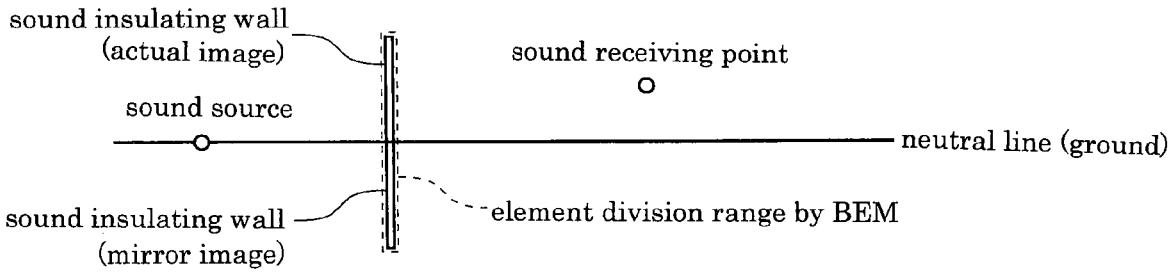
FIG. 9 is an explanatory view of the principle showing mirror image principle in a reflective ground in a boundary element method.

In numerical analysis, calculation with respect to sound field was performed as in FIG. 9 using a principle of reflection by the reflective ground. The target frequency range is 50 Hz band to 4000 Hz band, and the response with respect to the 1/81 octave band frequency was calculated. In obtaining the insertion loss with respect to the 1/3 octave band, the values of 27 frequencies contained in the respective band were energy produced to obtain the insertion loss. After performing a correction taking into consideration spectrum (A property weighing) of the road traffic noise with respect to the analytic value of the 1/3 octave band in the respective patterns of with/without barrier wall (sound insulating wall), energy was produced to obtain the overall value, and the insertion loss (O.A.) with respect to the road traffic noise was obtained by taking the difference of the two.

The result of analysis of the insertion loss at each sound receiving point R1 to R14 is shown in table 1, and each relative level (effect amount) with respect to the sample 2 (sound absorbing linear wall) is shown in table 2 for comparison.

TABLE 1

| Sound receiving point | Horizontal distance from barrier wall (m) | Height (m) | Sample 1 (linear wall) | Sample 2 (sound absorbing linear wall) | Sample 3 (present invention) |
|---|---|---|---|---|---|
| R1 | 5.0 | 0.0 | 17.0 | 17.7 | 19.9 |
| R5 | 10.0 | 0.0 | 15.7 | 16.3 | 18.2 |
| R2 | 5.0 | 1.2 | 19.4 | 20.1 | 22.2 |
| R6 | 10.0 | 1.2 | 18.7 | 19.3 | 21.3 |
| R9 | 15.0 | 1.2 | 18.4 | 19.0 | 21.0 |
| R12 | 20.0 | 1.2 | 18.3 | 18.8 | 20.3 |
| R3 | 5.0 | 3.5 | 13.7 | 14.1 | 15.5 |
| R7 | 10.0 | 3.5 | 15.7 | 16.2 | 17.6 |
| R10 | 15.0 | 3.5 | 16.4 | 16.9 | 18.3 |
| R13 | 20.0 | 3.5 | 16.7 | 17.2 | 18.8 |
| R4 | 5.0 | 5.0 | 5.3 | 5.4 | 5.8 |
| R8 | 10.0 | 5.0 | 12.4 | 12.7 | 13.8 |
| R11 | 15.0 | 5.0 | 14.5 | 14.9 | 16.1 |
| R14 | 20.0 | 5.0 | 15.4 | 15.9 | 17.1 |

TABLE 2

| Sound receiving point | Horizontal distance from barrier wall (m) | Height (m) | Sample 1 (linear wall) | Sample 2 (sound absorbing linear wall) | Sample 3 (present invention) |
|---|---|---|---|---|---|
| R1 | 5.0 | 0.0 | −0.7 | — | 2.2 |
| R5 | 10.0 | 0.0 | −0.6 | — | 1.9 |
| R2 | 5.0 | 1.2 | −0.7 | — | 2.2 |
| R6 | 10.0 | 1.2 | −0.6 | — | 2.0 |
| R9 | 15.0 | 1.2 | −0.6 | — | 2.0 |
| R12 | 20.0 | 1.2 | −0.6 | — | 1.5 |
| R3 | 5.0 | 3.5 | −0.4 | — | 1.4 |
| R7 | 10.0 | 3.5 | −0.5 | — | 1.4 |
| R10 | 15.0 | 3.5 | −0.5 | — | 1.5 |
| R13 | 20.0 | 3.5 | −0.5 | — | 1.5 |
| R4 | 5.0 | 5.0 | −0.2 | — | 0.4 |
| R8 | 10.0 | 5.0 | −0.3 | — | 1.1 |
| R11 | 15.0 | 5.0 | −0.4 | — | 1.2 |
| R14 | 20.0 | 5.0 | −0.4 | — | 1.3 |

From the results of tables 1 and 2, the sample 3 (sound insulating device of present invention) had a higher insertion loss and a higher relative level than sample 1 and sample 2 at all sound receiving points. Thus, the sound from the sound source was reduced the most in sample 3 among the samples used in the simulation, and thus proved to exert high sound insulating effect.

The operation in the soundproof device will now be specifically described.

The sound insulating wall 10 sound insulates by means of the sound insulating member 11(23) having a polyhedron shape with the sound source side opened, and thus effective sound insulation can be performed by applying principles such as multiple regression, interference of sound waves, enclosure of reflected sound, and the like. The sound wave that has advanced in the direction of the sound insulating member 11(23) advances to the plane portion 12*a*, 12*b*, 12*c*, 12*d*, 12*e*, 12*f* side configuring the polyhedron body 12. The sound wave that has reached each plane portion 12*a*, 12*b*, 12*c*, 12*d*, 12*e*, 12*f* is reflected by the plane portion 12*a*, 12*b*, 12*c*, 12*d*, 12*e*, 12*f*, but is collected so as to converge near substantially the center in cross section of the sound insulating member 23 since an angle is formed by the bent portion 15 in each plane portion 12*a*, 12*b*, 12*c*, 12*d*, 12*e*, 12*f*.

The collected sound waves interfere with and cancel each other, thereby obtaining a high sound insulating effect. From tables 1 and 2, the sound insulating efficiency is higher than the soundproof wall using a sound absorbing material.

Furthermore, since moisture is not absorbed as with the sound absorbing material, the sound insulating function will not deteriorate even in rain or snow, and thus the sound insulating wall 10 will not drastically deteriorate, whereby the sound insulting performance can be maintained over a long period. Thus, a high sound insulating effect will always be obtained without performing maintenance frequently.

In particular, the sound insulating member 11(23) of the present embodiment reflects the noise so as to be effectively collected when the noise is advanced in the direction of the sound insulating member 11 by bending the bending angle of each bent portion 15 to 142°, and thus maximum interference can be obtained.

The sound insulating member 11 is formed with the sandwiching portion 13 by forming the cutout portion 14 at both ends, the sandwiching portion 13 is sandwiched between the flanges 31, 31 of the H-shaped steel beam 30, and the sound insulating members 11 are continuously held so as to be stacked to form the sound insulating wall 10. Thus, satisfactory assembly workability and (since the sound absorbing material is not used and result in reduction in weight) further enhancement in workability are obtained, new components for fixing the sound insulating member 11 to the H-shaped steel beam 30 are not necessary, and high convenience is obtained in terms of conveyance and component management.

Moreover, the sound insulating member 11 can be configured by one member, and the sound insulating member 11 can be easily molded by press molding, extrusion, or pultrusion when forming the sound insulating member 11, and thus can be inexpensively mass produced. Furthermore, since the dimension in the length direction can be changed in molding, the sound insulating member 11 having a length that corresponds to the spacing of the H-shaped steel 30 beam can be formed.

The sound insulating member 11 is arranged in a substantially semicircular shape in cross section by forming the bent portion 15, is miniaturized while enhancing the sound insulating property, and can be installed without barely projecting to the road or the rail track side which is the noise producing side, whereby space is saved.

When the sound insulating member 11 is damaged, the sound insulating member 11 can be inexpensively disposed since it does not use the sound absorbing material and thus does not need to be disposed as industrial waste, and furthermore, is recyclable.

The sound insulating device of the present invention obtains sound insulating effect by being widely used in locations where noise is produced in addition to noise of expressways and railroads. Furthermore, the polyhedron shape of the sound insulating device of the present invention can be applied in various locations.

What is claimed is:

1. A sound insulating device comprising:

elongated sound insulating members each including a polyhedron body bent at a predetermined angle to open a sound source side, said sound insulating members being sequentially stacked between supporting columns arranged in an upstanding manner at a predetermined spacing to configure a sound insulating wall having an appropriate height, said sound insulating members being configured such that sound waves from the sound source interfere with each other due to the polyhedron body so as to reduce noise, wherein one end side of each of the sound insulating members is bent to an opening side on a side opposite to a bending direction of the bent portion to form a bending portion; and an elastic member fitted between each of the sound insulating members and the respective overlapping bending portion.

2. The sound insulating device according to claim 1, wherein the supporting column comprises an H-shaped steel beam, and the sound insulating members are stacked and fixedly attached by sandwiching a sandwiching portion formed at both ends of each of the sound insulating members between flanges of the H-shaped steel beam.

3. The sound insulating device according to claim 2, wherein the sandwiching portion is formed by arranging a cutout portion at both ends of the sound insulating member, a width allowing the sandwiching portion to be inserted between the flanges of the H-shaped steel beam is provided by the cutout portion, and the sandwiching portion is inserted and held between the flanges.

4. The sound insulating device according to claim 1, wherein the bent portion of each of the sound insulating members is bent to 142° to configure the polyhedron body.

5. The sound insulating device according to claim 1, wherein said elastic member is an elastomer.

6. The sound insulating device according to claim 1, further comprising a blocking plate fixedly attached to both ends of the sound insulating member by spot welding.

7. The sound insulating device according to claim 1, wherein a through hole is formed near upper and lower ends of each of the sound insulating members, and a connecting rope-like material is inserted through the through hole to integrally hold the stacked sound insulating members.

8. The sound insulating device according to claim 7, further comprising a pipe member interposed between the upper and lower pass-through holes to ensure the insertion of the connecting rope-like material.

* * * * *